US006736092B2

(12) United States Patent
Borean et al.

(10) Patent No.: US 6,736,092 B2
(45) Date of Patent: May 18, 2004

(54) INTERNAL-COMBUSTION ENGINE WITH AN ELECTRONICALLY CONTROLLED HYDRAULIC SYSTEM FOR ACTUATION OF THE VALVES AND MEANS FOR COMPENSATING CHANGES IN THE OPERATING CONDITIONS OF THE HYDRAULIC

(75) Inventors: Fabio Borean, Moncalieri (IT); Mitzi Puccio, Turin (IT)

(73) Assignee: C.R.F. Societa Consortile Perazioni, Turin (IT)

( * ) Notice: Subject to any disclaimer, the term of this patent is extended or adjusted under 35 U.S.C. 154(b) by 0 days.

(21) Appl. No.: 10/441,200

(22) Filed: May 20, 2003

(65) Prior Publication Data

US 2004/0000276 A1 Jan. 1, 2004

(30) Foreign Application Priority Data

Jul. 1, 2002 (IT) ..... TO2002A0568

(51) Int. Cl.[7] ..... F01L 9/02

(52) U.S. Cl. ..... 123/90.12; 123/90.16; 123/90.55; 123/198 F; 251/63.4; 251/77

(58) Field of Search ..... 123/90.12, 90.15, 123/90.16, 90.31, 90.48, 90.55, 198 F; 251/57, 62, 63.4, 77, 129.19

(56) References Cited

U.S. PATENT DOCUMENTS

| | | | | | |
|---|---|---|---|---|---|
| 4,324,210 | A | * | 4/1982 | Aoyama | 123/90.55 |
| RE33,538 | E | * | 2/1991 | Nakano et al. | 123/90.16 |
| 5,002,022 | A | * | 3/1991 | Perr | 123/90.12 |
| 6,237,551 | B1 | * | 5/2001 | Macor et al. | 123/90.15 |

* cited by examiner

*Primary Examiner*—Thomas Denion
*Assistant Examiner*—Kyle Riddle
(74) *Attorney, Agent, or Firm*—Sughrue Mion, PLLC

(57) ABSTRACT

In an internal-combustion engine equipped with an electronically controlled hydraulic system for variable actuation of the inlet and/or exhaust valves of the engine, the hydraulic system for actuation of the valves includes, for each engine valve, a solenoid valve for controlling the corresponding hydraulic actuator. Each solenoid valve is controlled according to a pre-set control criterion according to the operating parameters of the engine, said pre-set control criterion corresponding to reference operating conditions of the hydraulic fluid and, in particular, to the value of viscosity of the hydraulic fluid, which varies with temperature. The aforesaid control criterion is, however, adjusted according to an estimated deviation between reference operating conditions of the hydraulic fluid and actual operating conditions of the hydraulic fluid.

4 Claims, 2 Drawing Sheets

INTERNAL-COMBUSTION ENGINE WITH AN ELECTRONICALLY CONTROLLED HYDRAULIC SYSTEM FOR ACTUATION OF THE VALVES AND MEANS FOR COMPENSATING CHANGES IN THE OPERATING CONDITIONS OF THE HYDRAULIC

BACKGROUND OF THE INVENTION

The present invention relates to internal-combustion engines of the type comprising an electronically controlled hydraulic system for actuation of the inlet and/or exhaust valves.

The present applicant has already proposed, in the U.S. Pat. No. 6,237,551, an engine comprising:

at least one inlet valve and at least one exhaust valve for each cylinder, each provided with respective elastic-return means, which push the valve towards a closed position, for controlling respective induction and exhaust ducts;

at least one camshaft for actuating each inlet valve and exhaust valve of the cylinders of the engine by means of respective tappets, each inlet valve and exhaust valve being controlled by a respective cam of said camshaft, in which each of said tappets controls the respective inlet valve and exhaust valve against the action of said elastic-return means by the interposition of hydraulic means, which include a pressurized fluid chamber, the pressurized fluid chamber associated to each inlet valve or exhaust valve being designed for being connected by means of a solenoid valve to an exhaust duct for the purpose of uncoupling the valve from the respective tappet and causing rapid closing of the valve as a result of the respective elastic-return means; and electronic control means for controlling each solenoid valve for varying the time and stroke of opening of the respective inlet valve or exhaust valve according to one or more operating parameters of the engine.

In engines of the type specified above, movement of the valve depends not only upon the driving electrical command generated by the aforesaid electronic control means, but also upon the viscosity of the hydraulic fluid present in the actuation system. Said viscosity is subject to variations as the operating temperature varies.

SUMMARY OF THE INVENTION

The present applicant has already proposed in the past solutions that take into account the above problem, for example by intervening on the hydraulic braking device provided in engines of the type described above, the aim being to slow down (brake) the movement of closing of the valve as the valve approaches its completely closed position. The hydraulic braking device is necessary for preventing an excessively violent impact of the valve against its seat but must be excluded when the viscosity of the hydraulic fluid becomes too high, for example in conditions of cold starting at a very low ambient temperature, in so far as closing of the valve would be rendered too slow.

The purpose of the present invention is to provide a radical and more general solution to any problem that might arise during operation of the engine on account of the variations of viscosity of the hydraulic fluid used in the hydraulic system for variable control of the valves.

The above purpose is achieved, according to the invention, mainly by providing at least one temperature sensor for detecting the temperature of the hydraulic fluid in the proximity of the aforesaid hydraulic means for actuation of the valves and by the fact that the aforesaid electronic control means are programmed for estimating the viscosity of the hydraulic fluid according to the signal at output from the aforesaid temperature sensor and for controlling each of the aforesaid solenoid valves of the system for variable control of the engine valves according to the estimated value of viscosity.

Preferably, the electronic control means can be programmed so as to control the solenoid valves according to a pre-set reference criterion corresponding to pre-set reference operating conditions and to correct said criterion according to the estimated difference between the reference operating conditions and actual operating conditions.

The aforesaid pre-set reference operating conditions typically correspond in the first place to a range of values of fluid viscosity. However, the system may be further refined, by providing also a fluid-pressure sensor with the purpose of determining the presence of the fluid in the hydraulic circuit and evaluating the operating conditions not only upon the basis of the signal emitted by the temperature sensor but also on the basis of the signal emitted by the pressure sensor.

BRIEF DESCRIPTION OF THE DRAWINGS

Further characteristics and advantages of the invention will emerge clearly from the ensuing description with reference to the annexed drawings, which are provided purely by way of non-limiting example and in which.

DETAILED DESCRIPTION OF THE INVENTION

Figure 1:
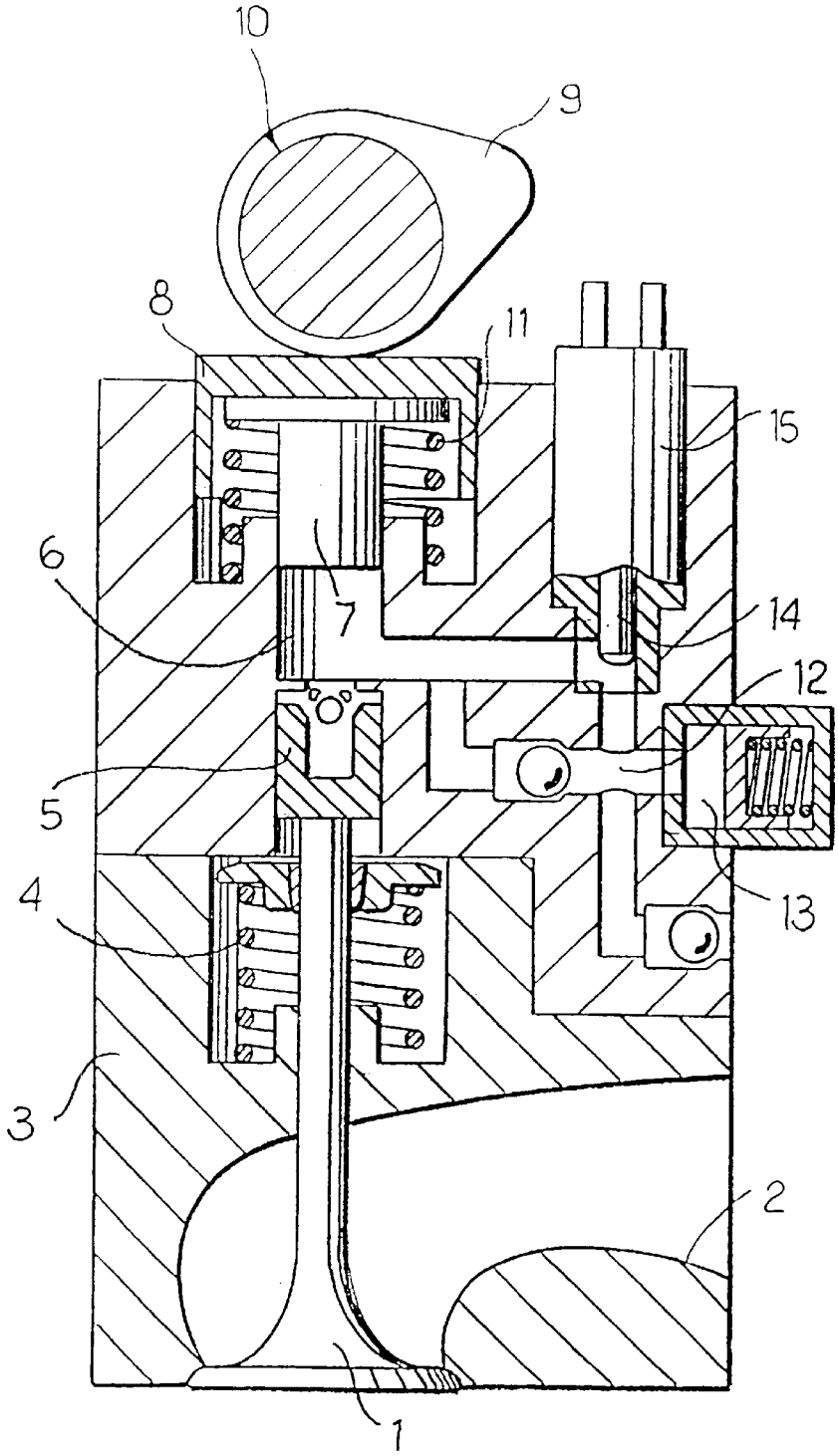
FIG. 1 is a schematic view illustrating the working principle of a system for variable actuation of the valves in an internal-combustion engine.

FIG. 1 is a schematic illustration of the principle of operation of a system for variable actuation of the valves in an internal-combustion engine. The reference number 1 designates as a whole the valve (which can be either an inlet valve, or an exhaust valve) associated to a respective duct 2 (either induction or exhaust) formed in a cylinder head 3 of an internal-combustion engine. The valve 1 is recalled towards its closed position (upwards, as viewed in FIG. 1) by a spring 4, whilst it is forced to open by a piston 5, which acts on the top end of the stem of the valve. The piston 5 is in turn controlled, via oil under pressure which is present inside a chamber 6, by a piston 7, which supports a tappet bucket 8 co-operating with a cam 9 of a camshaft 10. The bucket 8 is withheld, by a spring 11, in slidable contact with the cam 9. The pressure chamber 6 can be connected to a duct 12, which in turn communicates with a pressure accumulator 13, through the open/close element 14 of a solenoid valve 15, which is controlled by electronic control means (not illustrated) according to the conditions of operation of the engine. When the solenoid valve 15 is open, the oil under pressure, which is present in the chamber 6, is discharged, so that the valve 1 closes rapidly under the action of the elastic-return spring 4.

When the solenoid valve 15 is closed, the oil present in the chamber 6 transmits the movements of the piston 7 to the piston 5 and consequently to the valve 1 so that the position of the valve 1 is determined by the cam 9. In other words, the cam 9 normally controls opening of the valve 1 according to a cycle which depends upon the profile of the cam, but it can be "disabled" whenever required by opening the solenoid valve 15 so as to interrupt the connection between the piston 7 and the valve 1.

Figure 2:
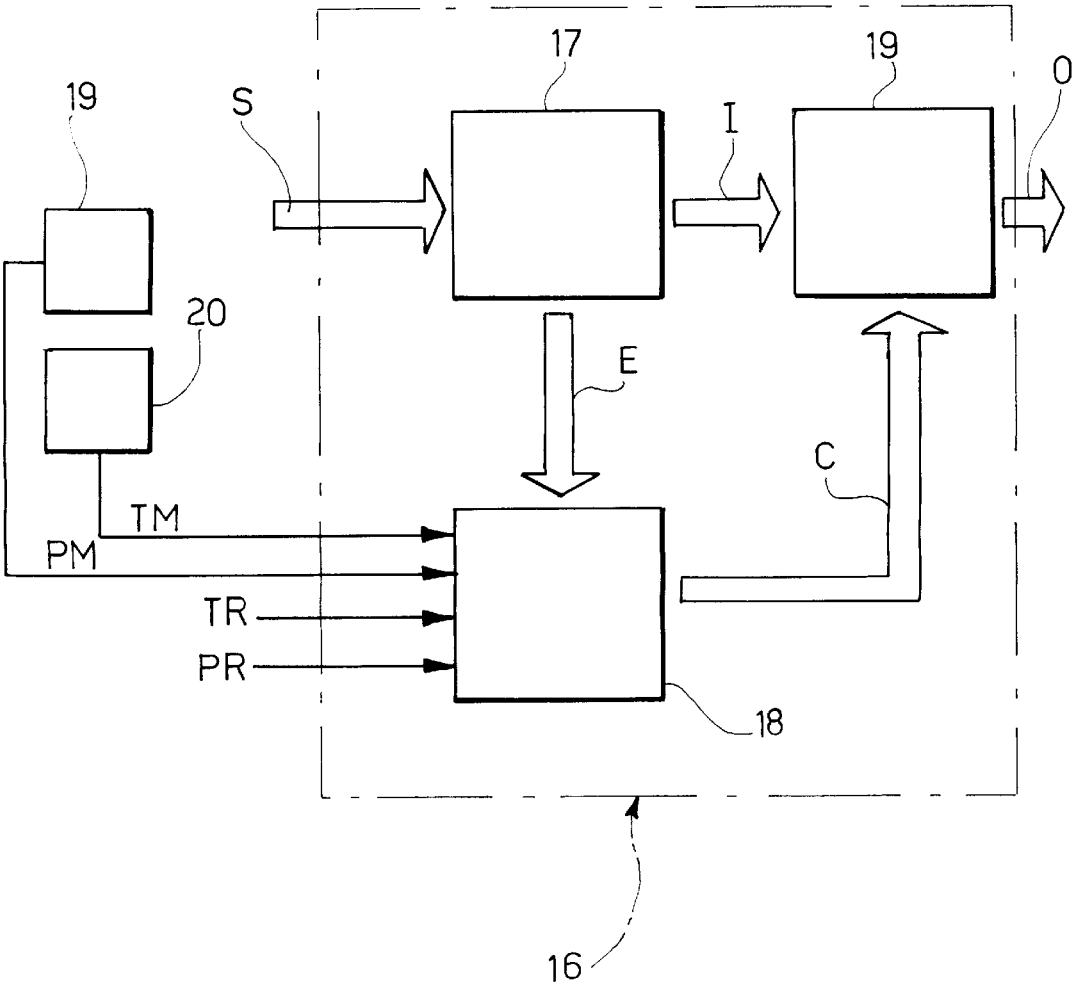
FIG. 2 is a block diagram which illustrates the principle of operation underlying the present invention.

In FIG. 2, the reference number 16 designates as a whole the electronic control unit associated to the engine according to the invention, which is provided for controlling the various solenoid valves 15 forming part of the system for variable control of the inlet and/or exhaust valves of the engine. Illustrated inside the block 16, which represents the entire unit, is a sub-block 17, designed for controlling the inlet and/or exhaust valves of the engine according to a pre-set reference criterion, corresponding to pre-set reference operating conditions. Block 17 carries out said control according to signals S which it receives from one or more sensors associated to the engine, said signals indicating the operating parameters of the engine (such as, for example, position of the accelerator, engine temperature, composition of the exhaust gases of the engine, etc.). The signal I at output from block 17 consequently represents the aforesaid pre-set control criterion corresponding to pre-set reference conditions. Block 18 represents a portion of the aforesaid electronic control means, which receives the signals $T_M$, $P_M$ at output from temperature and pressure sensors for detecting the temperature and pressure of the hydraulic fluid in the proximity of the hydraulic circuit for controlling the valves. Said sensors are designated by the reference numbers 19 and 20 in FIG. 16. Block 18 also receives at input the reference values $T_R$, $P_R$ of the fluid temperature and pressure, which are chosen empirically on the basis of tests carried out on the engine and represent normal operating conditions of the engine. Block 18 is designed to compensate for the variations of the operating conditions of the engine, and in particular the variations in viscosity of the hydraulic fluid. For this purpose, it is programmed for calculating, according to any appropriate predetermined algorithm, the value of viscosity of the hydraulic fluid according to the temperature value $T_M$ measured. Block 18 receives from block 17 a signal E, which represents operating parameters of the engine, and yields at output a signal C, which represents the correction that is to be applied to the criterion of valve control following upon variations in the environmental conditions.

Block 19 receives from block 17 the signal I, which represents the control criterion based upon the reference conditions, and the signal C at output from block 18, which represents the necessary correction following upon possible variations in the actual environmental conditions and yields at output a signal O for carrying out, in an optimal way, control of the solenoid valves of the hydraulic system for variable actuation of the engine valves, taking into account the necessary corrections to be applied to the control method following upon variations in the actual environmental conditions.

Of course, without prejudice to the aforesaid principle, the embodiments and details of construction may vary widely with respect to what is described and illustrated herein purely by way of example, without thereby departing from the scope of the present invention.

What is claimed is:

1. An internal combustion engine, comprising:

at least one inlet valve and at least one exhaust valve for each cylinder of the engine, each provided with respective elastic return means, which push the valve towards a closed position, for controlling respective inlet and exhaust ducts;

at least one camshaft for actuating each inlet and exhaust valve of the cylinders of the engine by means of respective tappets, each inlet and exhaust valve being controlled by a respective cam of said camshaft, in which each of said tappets controls the respective inlet and exhaust valve against the action of said elastic return means by means of the interposition of hydraulic means, which include a pressurized fluid chamber, the pressurized fluid chamber associated to each inlet or exhaust valve being designed for being connected, by means of a solenoid valve, to an exhaust duct for the purpose of uncoupling the valve from the respective tappet and causing rapid closing of the valve as a result of the respective elastic-return means; and electronic control means for controlling each solenoid valve for varying the time and the stroke of opening of the respective inlet or exhaust valve according to one or more operating parameters of the engine, wherein it further comprises at least one temperature sensor in the proximity of the aforesaid hydraulic means for actuating the valves, said electronic control means being programmed for estimating the viscosity of the hydraulic fluid according to the signal at output from said temperature sensor and for controlling each solenoid valve according to the estimate value of viscosity, and wherein the aforesaid electronic control means are programmed for controlling the inlet and/or exhaust valves of the engine according to a pre-set reference criterion based upon operating parameters of the engine, said pre-set reference criterion corresponding to pre-set reference operating conditions and said electronic control means being moreover programmed for correcting said control criterion according to the difference between the reference operating condition and the estimated actual operating conditions, the latter including both the estimated value of fluid viscosity and the value of fluid pressure measured with a pressure sensor.

2. A method for controlling the inlet and/or exhaust valves of an internal-combustion engine, said engine comprising:

at least one inlet valve and at least one exhaust valve for each cylinder of the engine, each provided with respective elastic return means, which push the valve towards a closed position, for controlling respective inlet and exhaust ducts;

at least one camshaft for actuating each inlet and exhaust valve of the cylinders of the engine by means of respective tappets, each inlet and exhaust valve being controlled by a respective cam of said camshaft, in which each of said tappets controls the respective inlet valve or exhaust valve against the action of said elastic return means by means of the interposition of hydraulic means, which include a pressurized fluid chamber, the pressurized fluid chamber associated to each inlet or exhaust valve being designed for being connected, by means of a solenoid valve, to an exhaust duct for the purpose of uncoupling the valve from the respective tappet and causing rapid closing of the valve as a result fo the respective elastic return means, and in which each solenoid valve is controlled for varying the time and the stroke of opening of the respective inlet or exhaust valve according to one or more operating parameters of the engine, wherein the value of temperature of the hydraulic fluid is detected in the proximity of the aforesaid hydraulic means for actuation of the inlet and/or exhaust valve of the engine, and the value of viscosity of the hydraulic fluid is estimated according to the detected temperature value, and in that the aforesaid solenoid valve is controlled according to the estimated viscosity value, and wherein each solenoid valve is controlled according to a pre-set reference criterion according to operating parameters of the engine, said pre-set reference criterion corresponding to pre-set reference operating conditions, and in that the aforesaid criterion is corrected according to the estimated deviation between reference operating condition and actual operating conditions.

3. The method according to claim 2, wherein said actual operating conditions are represented by the estimated value of viscosity of the hydraulic fluid.

4. The method according to claim 3, wherein said actual operating conditions also include the measured value of pressure of the hydraulic fluid.

* * * * *